US006210112B1

(12) United States Patent
Tabbita et al.

(10) Patent No.: US 6,210,112 B1
(45) **Date of Patent: *Apr. 3, 2001**

(54) APPARATUS FOR COOLING AN AIRFOIL FOR A GAS TURBINE ENGINE

(75) Inventors: Martin G. Tabbita; James P. Downs, both of Jupiter; Friedrich O. Soechting, Tequesta; Thomas A. Auxier, Palm Beach Gardens, all of FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/480,956

(22) Filed: Jan. 11, 2000

Related U.S. Application Data

(63) Continuation of application No. 08/992,322, filed on Dec. 17, 1997, now Pat. No. 6,050,777.

(51) Int. Cl.[7] ..... F01D 5/18; F01D 9/06

(52) U.S. Cl. ..... 416/97 R; 415/115; 29/889.721

(58) Field of Search ..... 416/97 R, 97 A; 415/115; 29/889.721, 889.722

(56) References Cited

U.S. PATENT DOCUMENTS

| | | | | |
|---|---|---|---|---|
| 3,836,283 | * | 9/1974 | Matsuki et al. | 416/96 R |
| 5,253,976 | * | 10/1993 | Cunha | 416/97 R |
| 5,356,265 | * | 10/1994 | Kercher | 416/97 R |
| 5,690,473 | * | 11/1997 | Kercher | 416/97 A |
| 5,779,437 | * | 7/1998 | Abdel-Messeh et al. | 415/115 |
| 6,050,777 | * | 4/2000 | Tabbita et al. | 416/97 R |

FOREIGN PATENT DOCUMENTS

| | | | | |
|---|---|---|---|---|
| 435906 | * | 10/1935 | (GB) | 416/97 R |
| 2127105 | * | 4/1984 | (GB) | 416/97 R |

* cited by examiner

*Primary Examiner*—Christopher Verdier
(74) *Attorney, Agent, or Firm*—Richard D. Getz

(57) ABSTRACT

A hollow airfoil is provided which includes a body, a trench, and a plurality of cooling apertures disposed within the trench. The body extends chordwise between a leading edge and a trailing edge, and spanwise between an outer radial surface and an inner radial surface, and includes an external wall surrounding a cavity. The trench is disposed in the external wall along the leading edge, extends in a spanwise direction, and is aligned with a stagnation line extending along the leading edge.

3 Claims, 2 Drawing Sheets

APPARATUS FOR COOLING AN AIRFOIL FOR A GAS TURBINE ENGINE

This application is a continuing application of U.S. patent application Ser. No. 08/992,322, having a filing date of Dec. 17, 1997, now U.S. Pat. No. 6,050,777.

BACKGROUND OF THE INVENTION

1. Technical Field

This invention relates to cooled rotor blades and/or stator vanes for gas turbines in general, and to apparatus and methods for cooling the leading edge and establishing film cooling along the surface of the rotor blade or stator vane in particular.

2. Background Information

In the turbine section of a gas turbine engine, core gas travels through a plurality of stator vane and rotor blade stages. Each stator vane or rotor blade has an airfoil with one or more internal cavities surrounded by an external wall. The suction and pressure sides of the external wall extend between the leading and trailing edges of the airfoil. Stator vane airfoils extend spanwise between inner and outer platforms and the rotor blade airfoils extend spanwise between a platform and a blade tip.

High temperature core gas (which includes air and combustion products) encountering the leading edge of an airfoil will diverge around the suction and pressure sides of the airfoil, or impinge on the leading edge. The point along the leading edge where the velocity of the core gas flow goes to zero (i.e., the impingement point) is referred to as the stagnation point. There is a stagnation point at every spanwise position along the leading edge of the airfoil, and collectively those points are referred to as the stagnation line. Air impinging on the leading edge of the airfoil is subsequently diverted around either side of the airfoil.

The precise location of each stagnation point along the length of the leading edge is a function of the angle of incidence of the core gas relative to the chordline of the airfoil, for both rotor and stator airfoils. In addition to the angle of incidence, the stagnation point of a rotor airfoil is also a function of the rotational velocity of the airfoil and the velocity of the core gas. Given the curvature of the leading edge, the approaching core gas direction and velocity, and the rotational speed of the airfoil (if any), the location of the stagnation points along the leading edge can be readily determined by means well-known in the art. In actual practice, rotor speeds and core gas velocities vary depending upon engine operating conditions as a function of time and position along the span of the airfoil. As a result, the stagnation points (or collectively the stagnation line) along the leading edge of an airfoil will move relative to the leading edge.

Cooling air, typically bled off of a compressor stage at a temperature lower and pressure higher than the core gas passing through the turbine section, is used to cool the airfoils. The cooler compressor air provides the medium for heat transfer and the difference in pressure provides the energy required to pass the cooling air through the stator or rotor stage.

In many cases, it is desirable to establish film cooling along the surface of the stator or rotor airfoil. A film of cooling air traveling along the surface of the airfoil transfers thermal energy away from the airfoil, increases the uniformity of the cooling, and insulates the airfoil from the passing hot core gas. A person of skill in the art will recognize, however, that film cooling is difficult to establish and maintain in the turbulent environment of a gas turbine. In most cases, film cooling air is bled out of cooling apertures extending through the external wall of the airfoil. The term "bled" reflects the small difference in pressure motivating the cooling air out of the internal cavity of the airfoil.

One of the problems associated with using apertures to establish a cooling air film is the films sensitivity to pressure difference across the apertures. Too great a pressure difference across an aperture will cause the air to jet out into the passing core gas rather than aid in the formation of a film of cooling air. Too small a pressure difference will result in negligible cooling air flow through the aperture, or an in-flow of hot core gas. Both cases adversely affect film cooling effectiveness. Another problem associated with using apertures to establish film cooling is that cooling air is dispensed from discrete points along the span of the airfoil, rather than along a continuous line. The gaps between the apertures, and areas immediately downstream of those gaps, are exposed to less cooling air than are the apertures and the spaces immediately downstream of the apertures, and are therefore more susceptible to thermal degradation. Another problem associated with using apertures to establish film cooling is the stress concentrations that accompany the apertures. Film cooling effectiveness generally increases when the apertures are closely packed and skewed at a shallow angle relative to the external surface of the airfoil. Skewed, closely packed apertures, however, create stress concentrations.

Some prior art discloses the use of a porous transpiration strip disposed in a recess as a means to create a plenum in a forward portion of an airfoil. The transpiration strip has an arcuate outer profile that, when attached to the recess, provides the airfoil with an aerodynamic leading edge profile. Air entering the plenum through metering holes diffuses through the transpiration strip. A problem with this approach, particularly in those instances where the transpiration strip extends between the pressure and suction sides through the leading edge, is that pressure gradients along the leading can influence where cooling air exits the transpiration strip along the leading edge. The high pressure region that typically resides adjacent the stagnation line of an airfoil during operation, for example, will force cooling air to exit the transpiration strip in regions of lesser pressure. As a result, the leading edge region aligned with the stagnation line, which is typically subjected to some of the highest temperatures, may not be cooled as effectively as other regions of the transpiration strip. Another problem with transpiration cooling occurs when the strip becomes clogged with debris. The debris can inhibit or prevent cooling air from reaching portions of the strip, leaving those portions susceptible to undesirably high temperatures and consequent thermal degradation.

What is needed is an apparatus that provides adequate cooling along the leading edge of an airfoil, one that accommodates a variable position stagnation line, one that creates a uniform and durable cooling air film downstream of the leading edge on both sides of the airfoil, and one that creates minimal stress concentrations in the airfoil wall.

DISCLOSURE OF THE INVENTION

It is, therefore, an object of the present invention to provide an airfoil having improved cooling along the leading edge.

It is another object of the present invention to provide an airfoil with leading edge cooling apparatus that accommodates a plurality of stagnation lines.

It is another object of the present invention to provide an airfoil with leading edge cooling apparatus that establishes uniform and durable film cooling downstream of the leading edge on both sides of the airfoil.

It is another object of the present invention to provide an airfoil with leading edge cooling apparatus that creates minimal stress concentrations within the airfoil wall.

According to the present invention, a hollow airfoil is provided which includes a body, a trench, and a plurality of cooling apertures disposed within the trench. The body extends chordwise between leading and trailing edges and spanwise between inner and outer radial surfaces, and includes an external wall surrounding an internal cavity. The trench is disposed in the external wall along the leading edge, extends in a spanwise direction, and is aligned with a stagnation line extending along the leading edge.

According to one aspect of the present invention, a method for cooling an airfoil is provided wherein a trench is provided disposed in the external wall of the airfoil. The trench is aligned with a stagnation line for the airfoil.

An advantage of the present invention is that uniform and durable film cooling downstream of the leading edge is provided on both sides of the airfoil. The cooling air bleeds out of the trench on both sides and creates continuous film cooling downstream of the leading edge. The trench minimizes cooling losses characteristic of cooling apertures, and thereby provides more cooling air for film development and maintenance.

Another advantage of the present invention is that stress is minimized along the leading edge and areas immediately downstream of the leading edge. The trench of cooling air that extends continuously along the leading edge minimizes thermally induced stress by eliminating the discrete cooling points separated by uncooled areas characteristic of conventional cooling schemes. The uniform film of cooling air that exits from both sides of the trench also minimizes thermally induced stress by eliminating uncooled zones between and downstream of cooling apertures characteristic of conventional cooling schemes.

Another advantage of the present invention is that the leading edge cooling apparatus accommodates a plurality of stagnation lines. In the most preferable embodiment, the trench is preferably centered on the stagnation line which coincides with the largest heat load operating condition for a given application, and the width of the trench is preferably large enough such that the stagnation line will not travel outside of the side walls of the trench under all operating conditions. As a result, the present invention provides improved leading edge cooling and cooling air film formation relative to conventional cooling schemes.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
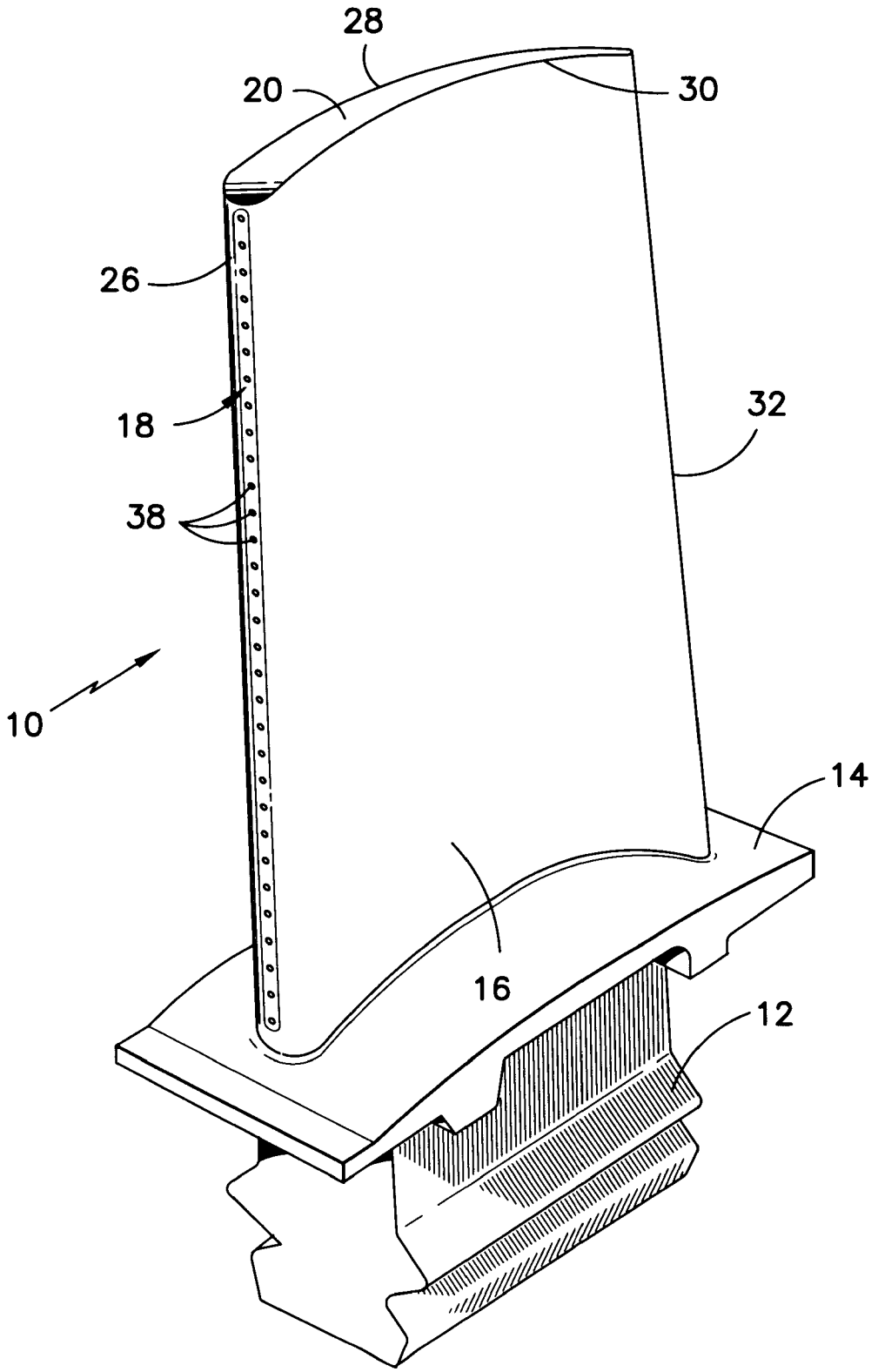
FIG. 1 is a diagrammatic perspective view of a turbine rotor blade for a gas turbine engine.

Referring to FIG. 1, a gas turbine engine turbine rotor blade 10 includes a root portion 12, a platform 14, an airfoil 16, a trench 18 disposed in the airfoil 16, and a blade tip 20. The airfoil 16 comprises one or more internal cavities 22 (see FIG. 2) surrounded by an external wall 24, at least one of which is proximate the leading edge 26 of the airfoil 16. The suction side 28 and the pressure side 30 of the external wall 24 extend chordwise between the leading edge 26 and the trailing edge 32 of the airfoil 16, and spanwise between the platform 14 and the blade tip 20. The leading edge 26 has a smoothly curved contour which blends with the suction side 28 and pressure side 30 of the airfoil 16.

Figure 2:
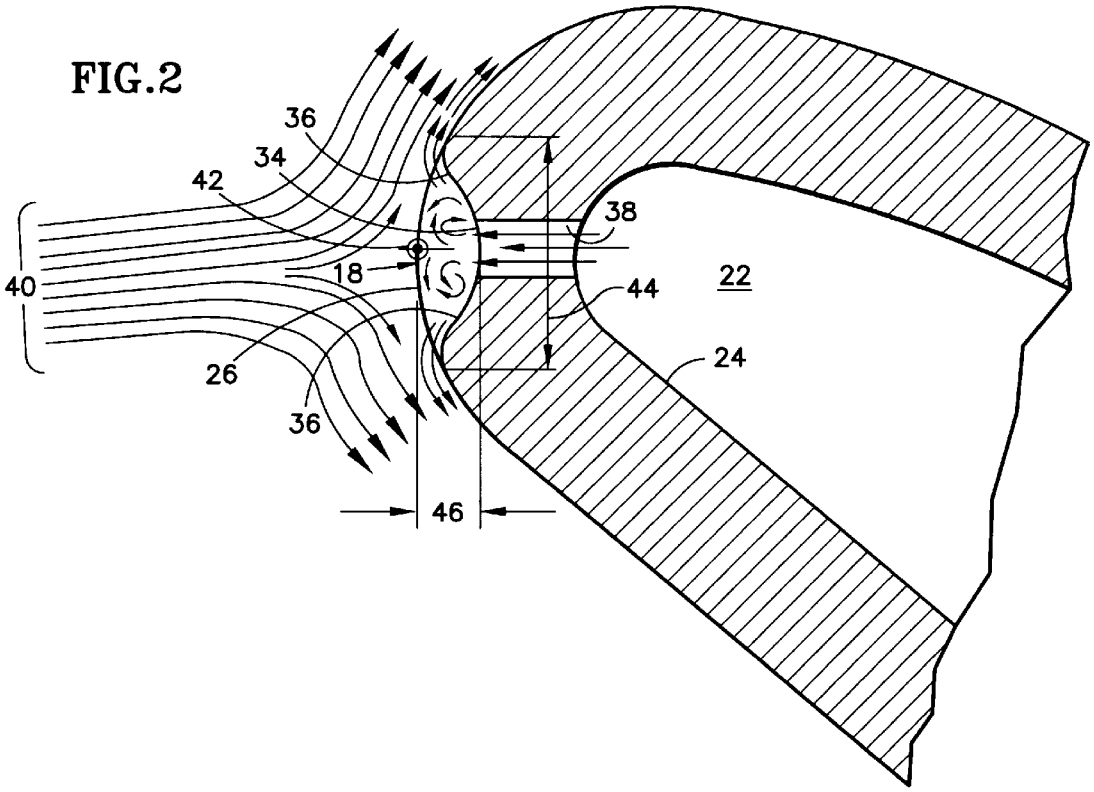
FIG. 2 is a partial sectional view of the airfoil portion of the rotor blade shown in FIG. 1, including core gas flow lines to illustrate the relative position of the trench and the stagnation point of the airfoil. The partial sectional view of the airfoil shown in this drawing also represents the airfoil of a stator vane.

Referring to FIG. 2, the trench 18 includes a base 34 and a pair of side walls 36 disposed in the external wall 24 along the leading edge 26, preferably extending substantially the entire span of the airfoil 16. A plurality of cooling apertures 38 provide passages between the trench 18 and the forward most internal cavity 22 for cooling air. The shape of the cooling apertures 38 and their position within the trench 18 will vary depending upon the application. FIG. 2 includes streamlines 40 representing core gas within the core gas path to illustrate the direction of core gas relative to the airfoil 16.

Figure 3:
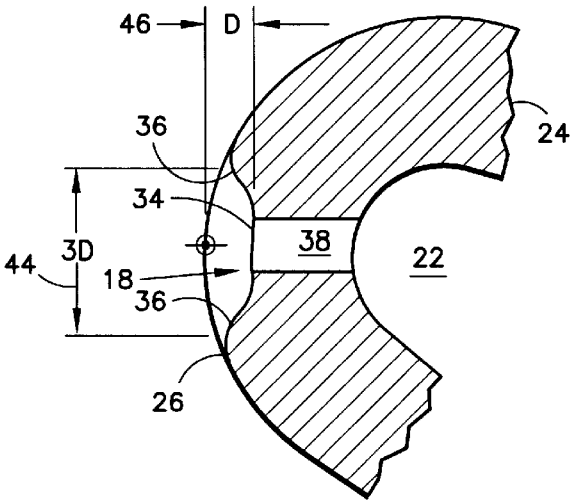
FIG. 3 is a diagrammatic sectional view of a trench disposed in the leading edge of an airfoil.

As stated earlier, the stagnation point 42 (or in collective terms, the stagnation line) at any particular position along the span will move depending upon the engine operating condition at hand. The trench 18 is preferably centered on those stagnation points 42 which coincide with the largest heat load operating condition for a given application, and the width 44 of the trench 18 is preferably large enough such that the stagnation line 42 will not travel outside of the side walls 36 of the trench 18 under all operating conditions. If, however, it is not possible to provide a trench 18 wide enough to accommodate all possible stagnation line 42 positions, then the width 44 and the position of the trench 18 are chosen to accommodate the greatest number of stagnation lines 42 that coincide with the highest heat load operating conditions. The most appropriate trench width 44 and depth 46 for a given application can be determined by empirical study. Referring to FIG. 3 for example, empirical studies indicate that a trench 18 for a rotor airfoil 16 having a depth 46 substantially equal to one (1) cooling aperture 38 diameter ("D") and a width 44 substantially equal to three (3) cooling aperture 38 diameters ("3D"), where the cooling aperture 38 is that which is disposed within the trench 18, provides favorable leading edge 26 cooling and downstream cooling air film formation.

In the operation of the invention, cooling air typically bled off of a compressor stage (not shown) is routed into the airfoil 16 of the rotor blade 10 (or stator vane) by means well known in the art. Cooling air disposed within the internal cavity 22 proximate the leading edge 26 of the airfoil 16 is at a lower temperature and higher pressure than the core gas flowing past the external wall 24 of the airfoil 16. The pressure difference across the airfoil external wall 24 forces the internal cooling air to enter the cooling apertures 38 and subsequently pass into the trench 18 located in the external wall 24 along the leading edge 26. The cooling air exiting the cooling apertures 38 diffuses into the air already in the trench 18 and distributes within the trench 18. The cooling air subsequently exits the trench 18 in a substantially uniform manner over the side walls 36 of the trench 18. The exiting flow forms a film of cooling air on both sides of the trench 18 that extends downstream.

One of the advantages of distributing cooling air within the trench 18 is that the pressure difference problems characteristic of conventional cooling apertures (not shown) are minimized. For example, the difference in pressure across a cooling aperture 38 is a function of the local internal cavity 22 pressure and the local core gas pressure adjacent the aperture 38. Both of these pressures vary as a function of time. If the core gas pressure is high and the internal cavity pressure is low adjacent a particular cooling aperture in a conventional scheme (not shown), undesirable hot core gas in-flow can occur. The present invention minimizes the opportunity for the undesirable in-flow because the cooling air from all apertures 38 distributes and increases in uniformity within the trench 18, thereby decreasing the opportunity for any low pressure zones to occur. Likewise, the distribution of cooling air within the trench 18 also avoids cooling air pressure spikes which, in a conventional scheme, would jet the cooling air into the core gas rather than add it to the film of cooling air downstream.

Although this invention has been shown and described with respect to the detailed embodiments thereof, it will be understood by those skilled in the art that various changes in form and detail thereof may be made without departing from the spirit and the scope of the invention. For example, FIG. 2 shows a partial sectional view of an airfoil 16. The airfoil 16 may be that of a stator vane or a rotor blade.

What is claimed is:

1. A hollow airfoil, comprising:

a body having an external wall surrounding an internal cavity and a spanwise extending leading edge;

an open trench disposed in said external wall along said leading edge and extending in a spanwise direction, said trench having a first side wall, a second side wall, and a base extending between said first and second side walls;

wherein said side walls are sufficiently spaced apart such that under substantially all operating conditions said stagnation line is substantially disposed between said first and second side walls; and a plurality of cooling apertures disposed within said trench and extending through said external wall, thereby providing a cooling air passage between said internal cavity and said trench, each said cooling aperture having a diameter.

2. The hollow airfoil of claim 1, wherein each said cooling aperture has a diameter, and said trench has a depth substantially equal to said diameter and a width substantially equal to three of said diameters.

3. The hollow airfoil of claim 1, wherein said trench includes a depth and a width, and said width is greater than said depth.

* * * * *